US007398840B2

(12) United States Patent
Ladi et al.

(10) Patent No.: US 7,398,840 B2
(45) Date of Patent: Jul. 15, 2008

(54) MATRIX DRILL BITS AND METHOD OF MANUFACTURE

(75) Inventors: Ram L. Ladi, Tomball, TX (US); Gary Weaver, Conroe, TX (US); David A. Brown, New Caney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 181 days.

(21) Appl. No.: 11/329,595

(22) Filed: Jan. 10, 2006

(65) Prior Publication Data

US 2006/0231293 A1 Oct. 19, 2006

Related U.S. Application Data

(60) Provisional application No. 60/671,272, filed on Apr. 14, 2005.

(51) Int. Cl.
*E21B 10/36* (2006.01)
*B21K 5/04* (2006.01)

(52) U.S. Cl. ..... 175/425; 175/374; 76/108.2

(58) Field of Classification Search ..... 175/374, 175/425; 76/108.2

See application file for complete search history.

(56) References Cited

U.S. PATENT DOCUMENTS

| | | | | |
|---|---|---|---|---|
| 3,471,921 | A | 10/1969 | Feenstra | 29/473.1 |
| 3,757,878 | A | 9/1973 | Wilder et al. | 175/329 |
| 3,757,879 | A | 9/1973 | Wilder et al. | 175/329 |
| 4,274,769 | A * | 6/1981 | Multakh | 408/145 |
| 4,460,053 | A | 7/1984 | Jurgens et al. | 175/329 |
| 4,669,522 | A | 6/1987 | Griffin | 164/97 |
| 4,834,963 | A | 5/1989 | Terry et al. | 423/440 |
| 4,884,477 | A | 12/1989 | Smith et al. | 76/108 |
| 5,000,273 | A | 3/1991 | Horton et al. | 175/329 |
| 5,007,493 | A | 4/1991 | Coolidge et al. | 175/329 |
| 5,033,560 | A | 7/1991 | Sawyer et al. | 175/410 |
| 5,090,491 | A | 2/1992 | Tibbitts | 175/409 |
| 5,373,907 | A | 12/1994 | Weaver | 175/426 |
| 5,492,186 | A | 2/1996 | Overstreet et al. | 175/374 |

(Continued)

FOREIGN PATENT DOCUMENTS

GB 2328233 A 8/1998

(Continued)

OTHER PUBLICATIONS

Patent Act 1977: Search Report under Section 17(5), Application No. GB0607379.5, 3 pages, May 31, 2006.

*Primary Examiner*—David J. Bagnell
*Assistant Examiner*—Brad Harcourt
(74) *Attorney, Agent, or Firm*—Baker Botts L.L.P.

(57) ABSTRACT

A matrix drill bit and method of manufacturing a matrix bit body from a composite of matrix materials is disclosed. Two or more different types of matrix materials may be used to form a composite matrix bit body. A first matrix material may be selected to provide optimum fracture resistance (toughness) and optimum erosion, abrasion and wear resistance for portions of a matrix bit body such as cutter sockets, cutting structures, blades, junk slots and other portions of the bit body associated with engaging and removing formation materials. A second matrix material may be selected to provide desired infiltration of hot, liquid binder material with the first matrix material to form a solid, coherent, composite matrix bit body.

9 Claims, 4 Drawing Sheets

U.S. PATENT DOCUMENTS

| | | | | |
|---|---|---|---|---|
| 5,678,644 | A | 10/1997 | Fielder | 175/391 |
| 5,848,348 | A | 12/1998 | Dennis | 419/5 |
| 6,045,750 | A * | 4/2000 | Drake et al. | 419/6 |
| 6,296,069 | B1 | 10/2001 | Lamine et al. | 175/434 |
| 6,302,224 | B1 | 10/2001 | Sherwood, Jr. | 175/397 |
| 6,655,481 | B2 | 12/2003 | Findley et al. | 175/425 |
| 2004/0245024 | A1 | 12/2004 | Kembaiyan | 175/425 |
| 2006/0032335 | A1 | 2/2006 | Kembaiyan | 76/108.1 |

FOREIGN PATENT DOCUMENTS

| | | |
|---|---|---|
| WO | 2005106183 | 11/2005 |

* cited by examiner

100

MATRIX DRILL BITS AND METHOD OF MANUFACTURE

RELATED APPLICATIONS

This application claims the benefit of U.S. Provisional Patent Application entitled "MATRIX DRILL BITS AND METHOD OF MANUFACTURE," application Ser. No. 60/671,272 filed Apr. 14, 2005.

TECHNICAL FILED

The present invention is related to rotary drill bits and more particularly to matrix drill bits having a composite matrix bit body formed in part by at least a first matrix material and a second matrix material.

BACKGROUND OF THE INVENTION

Rotary drill bits are frequently used to drill oil and gas wells, geothermal wells and water wells. Rotary drill bits may be generally classified as rotary cone or roller cone drill bits and fixed cutter drilling equipment or drag bits. Fixed cutter drill bits or drag bits are often formed with a matrix bit body having cutting elements or inserts disposed at select locations of exterior portions of the matrix bit body. Fluid flow passageways are typically formed in the matrix bit body to allow communication of drilling fluids from associated surface drilling equipment through a drill string or drill pipe attached to the matrix bit body. Such fixed cutter drill bits or drag bits may sometimes be referred to as "matrix drill bits."

Matrix drill bits are typically formed by placing loose matrix material (sometimes referred to as "matrix powder" into a mold and infiltrating the matrix material with a binder such as a copper alloy. The mold may be formed by milling a block of material such as graphite to define a mold cavity with features that correspond generally with desired exterior features of the resulting matrix drill bit. Various features of the resulting matrix drill bit such as blades, cutter pockets, and/or fluid flow passageways may be provided by shaping the mold cavity and/or by positioning temporary displacement material within interior portions of the mold cavity. A preformed steel shank or bit blank may be placed within the mold cavity to provide reinforcement for the matrix bit body and to allow attachment of the resulting matrix drill bit with a drill string.

A quantity of matrix material typically in powder form may then be placed within the mold cavity. The matrix material may be infiltrated with a molten metal alloy or binder which will form a matrix bit body after solidification of the binder with the matrix material. Tungsten carbide powder is often used to form conventional matrix bit bodies.

SUMMARY OF THE DISCLOSURE

In accordance with teachings of the present disclosure, a first matrix material and a second matrix material cooperate with each other to eliminate or substantially reduce problems encountered in forming sound matrix drill bits free from internal flaws. One aspect of the present disclosure may include placing a first matrix material into a mold to form blades, cutter pockets, junk slots and other exterior portions of an associated matrix drill bit. A metal blank or casting mandrel may be installed in the mold above the first matrix material. A second matrix material may then be added into the mold. The second matrix material may be selected to allow rapid infiltration or flow of liquid binder material into and throughout the first matrix material. As a result, alloy segregation in the last solidifying portion of the binder material and first matrix material may be substantially reduced or eliminated. The first matrix material may also provide desired enhancement in transverse rupture strength, impact strength, erosion, abrasion and wear characteristics for an associated composite matrix drill bit.

Cooperation between the second matrix material and the binder may substantially reduce and/or eliminate quality problems associated with unsatisfactory infiltration of binder material through the first matrix material. Porosity, shrinkage, cracking, segregation and/or lack of bonding of binder material with the first matrix material may be reduced or eliminated by the addition of a second matrix material. The first matrix material may be cemented carbides of tungsten, titanium, tantalum, niobium, chromium, vanadium, molybdenum, hafnium independently or in combination and/or spherical carbides. The second matrix material may be macrocrystalline tungsten carbide and/or tungsten cast carbide. However, the present disclosure is not limited to cemented tungsten carbides, spherical carbides, macrocrystalline tungsten carbide and/or cast tungsten carbides or mixtures thereof. Also, teachings of the present disclosure may be used to fabricate or cast relatively large composite matrix bit bodies and relatively small, complex composite matrix bit bodies.

Technical benefits of the disclosure include, but are not limited to, eliminating or substantially reducing quality problems associated with incomplete infiltration or binding of hard particulate matter associated with matrix drill bits. Examples of such quality problems include, but are not limited to, reduction in alloy segregation, formation of undesired intermetallic compounds, porosity and/or undesired holes or void spaces formed in an associated matrix bit body.

One aspect of the disclosure includes forming a matrix drill bit having a first portion or first zone formed in part from cemented carbides and/or spherical carbides which provide increased toughness along with improved abrasion, erosion and wear resistance and a second portion or a second zone formed in part from macrocrystalline tungsten carbide and/or cast carbides which enhances infiltration of hot, liquid binder material throughout the cemented carbides and/or spherical carbides.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1:
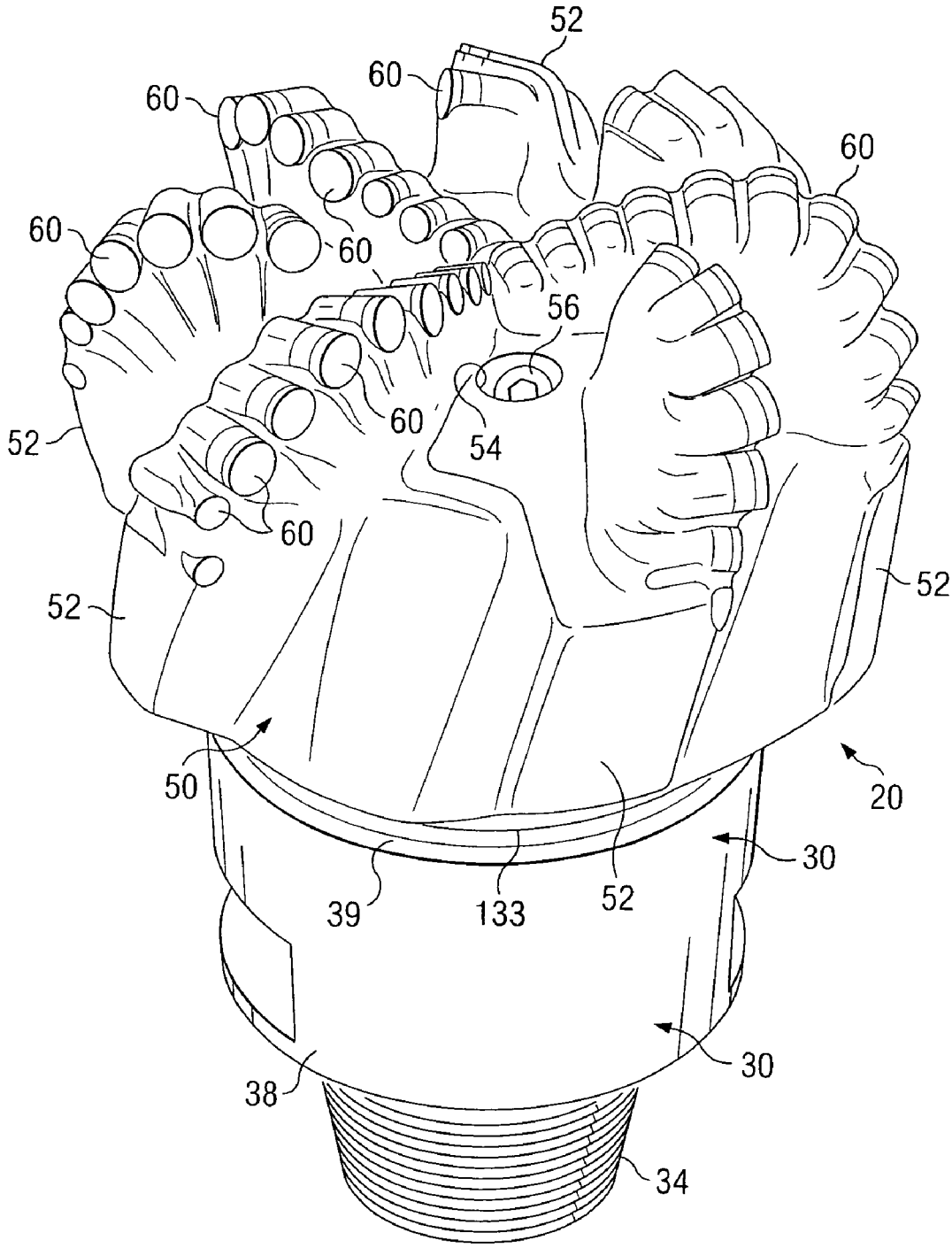
FIG. 1 is a schematic drawing showing an isometric view of a fixed cutter drill bit having a matrix bit body formed in accordance with teachings of the present disclosure.

Preferred embodiments of the disclosure and its advantages are best understood by reference to FIGS. 1-4 wherein like numbers refer to same and like parts.

The terms "matrix drill bit" and "matrix drill bits" may be used in this application to refer to "rotary drag bits", "drag bits", "fixed cutter drill bits" or any other drill bit incorporating teaching of the present disclosure. Such drill bits may be used to form well bores or boreholes in subterranean formations.

Matrix drill bits incorporating teachings of the present disclosure may include a matrix bit body formed in part by at least a first matrix material and a second matrix material. Such matrix drill bits may be described as having a composite matrix bit body since at least two different matrix materials with different performance characteristics may be used to form the bit body. As discussed later in more detail, more than two matrix materials may be used to form a matrix bit body in accordance with teaching of the present disclosure For some applications the first matrix material may have increased toughness or high resistance to fracture and also provide desired erosion, abrasion and wear resistance. The second matrix material preferably has only a limited amount (if any) of alloy materials or other contaminates. The first matrix material may include, but is not limited to, cemented carbides or spherical carbides. The second matrix material may include, but is not limited to, macrocrystalline tungsten carbides and/or cast carbides.

Various types of binder materials may be used to infiltrate matrix materials to form a matrix bit body. Binder materials may include, but are not limited to, copper (Cu), nickel (Ni), cobalt (Co), iron (Fe), molybdenum (Mo) individually or alloys based on these metals. The alloying elements may include, but are not limited to, one or more of the following elements—manganese (Mn), nickel (Ni), tin (Sn), zinc (Zn), silicon (Si), molybdenum (Mo), tungsten (W), boron (B) and phosphorous (P). The matrix bit body may be attached to a metal shank. A tool joint having a threaded connection operable to releasably engage the associated matrix drill bit with a drill string, drill pipe, bottom hole assembly or downhole drilling motor may be attached to the metal shank.

The terms "cemented carbide" and "cemented carbides" may be used within this application to include WC, MoC, TiC, TaC, NbC, $Cr_3C_2$, VC and solid solutions of mixed carbides such as WC—TiC, WC—TiC—TaC, WC—TiC—(Ta,Nb)C in a metallic binder (matrix) phase. Typically, Co, Ni, Fe, Mo and/or their alloys may be used to form the metallic binder. Cemented carbides may sometimes be referred to as "composite" carbides or sintered carbides. Some cemented carbides may also be referred to as spherical carbides. However, cemented carbides may have many configurations and shapes other than spherical.

Cemented carbides may be generally described as powdered refractory carbides which have been united by compression and heat with binder materials such as powdered cobalt, iron, nickel, molybdenum and/or their alloys. Cemented carbides may also be sintered, crushed, screened and/or further processed as appropriate. Cemented carbide pellets may be used to form a matrix bit body. The binder material provides ductility and toughness which often results in greater resistance to fracture (toughness) of cemented carbide pellets, spheres or other configurations as compared to cast carbides, macrocrystalline tungsten carbide and/or formulates thereof.

The binder materials used to form cemented carbides may sometimes be referred to as "bonding materials" in this patent application to help distinguish between binder materials used to form cemented carbides and binder materials used to form a matrix drill bit.

As discussed later in more detail, metallic elements and/or their alloys in bonding materials associated with cemented carbides may "contaminate" hot, liquid (molten) infiltrants such as copper based alloys and other types of binder materials associated with forming matrix drill bits as the molten infiltrant travels through the cemented carbides prior to solidifying to form a desired matrix. This kind of "contamination" (enrichment of infiltrant with bonding material from cemented carbides) of a molten infiltrant may alter the solidus (temperature below which infiltrant is all solid) and liquidus (temperature above which infiltrant is all liquid) of the infiltrant as it travels under the influence of capillary action through the cemented carbide. This phenomena may have an adverse effect on the wettability of the cemented carbides resulting in lack of satisfactory infiltration of the cemented carbides prior to solidifying to form the desired matrix.

Cast carbides may generally be described as having two phases, tungsten monocarbide and ditungsten carbide. Cast carbides often have characteristics such as hardness, wettability and response to contaminated hot, liquid binders which are different from cemented carbides or spherical carbides.

Macrocrystalline tungsten carbide may be generally described as relatively small particles (powders) of single crystals of monotungsten carbide with additions of cast carbide, Ni, Fe, Carbonyl of Fe, Ni, etc. Both cemented carbides and macrocrystalline tungsten carbides are generally described as hard materials with high resistance to abrasion, erosion and wear. Macrocrystalline tungsten carbide may also have characteristics such as hardness, wettability and response to contaminated hot, liquid binders which are different from cemented carbides or spherical carbides.

The terms "binder" or "binder material" may be used in this application to include copper, cobalt, nickel, iron, any alloys of these elements or any other material satisfactory for use in forming a matrix drill bit. Such binders generally provide desired ductility, toughness and thermal conductivity for an associated matrix drill bit. Other materials such as, but not limited to, tungsten carbide have previously been used as binder materials to provide resistance to erosion, abrasion and wear of an associated matrix drill bit. Binder materials may cooperate with two or more different types of matrix materials selected in accordance with teachings of the present disclosure to form composite matrix bit bodies with increased toughness and wear properties as compared to many conventional matrix bit bodies.

FIG. 1 is a schematic drawing showing one example of a matrix drill bit or fixed cutter drill bit formed with a composite matrix bit body in accordance with teachings of the present disclosure. For embodiments such as shown in FIG. 1, matrix drill bit 20 may include metal shank 30 with composite matrix bit body 50 securely attached thereto. Metal shank 30 may be described as having a generally hollow, cylindrical configuration defined in part by fluid flow passageway 32 in FIG. 3. Various types of threaded connections, such as American Petroleum Institute (API) connection or threaded pin 34, may be formed on metal shank 30 opposite from composite matrix bit body 50.

For some applications generally cylindrical metal blank or casting blank 36 (See FIGS. 2 and 3) may be attached to hollow, generally cylindrical metal shank 30 using various techniques. For example annular weld groove 38 (See FIG. 3) may be formed between adjacent portions of blank 36 and shank 30. Weld 39 may be formed in grove 38 between blank 36 and shank 30. See FIG. 1. Fluid flow passageway or longitudinal bore 32 preferably extends through metal shank 30 and metal blank 36. Metal blank 36 and metal shank 30 may be formed from various steel alloys or any other metal alloy associated with manufacturing rotary drill bits.

Figure 2:
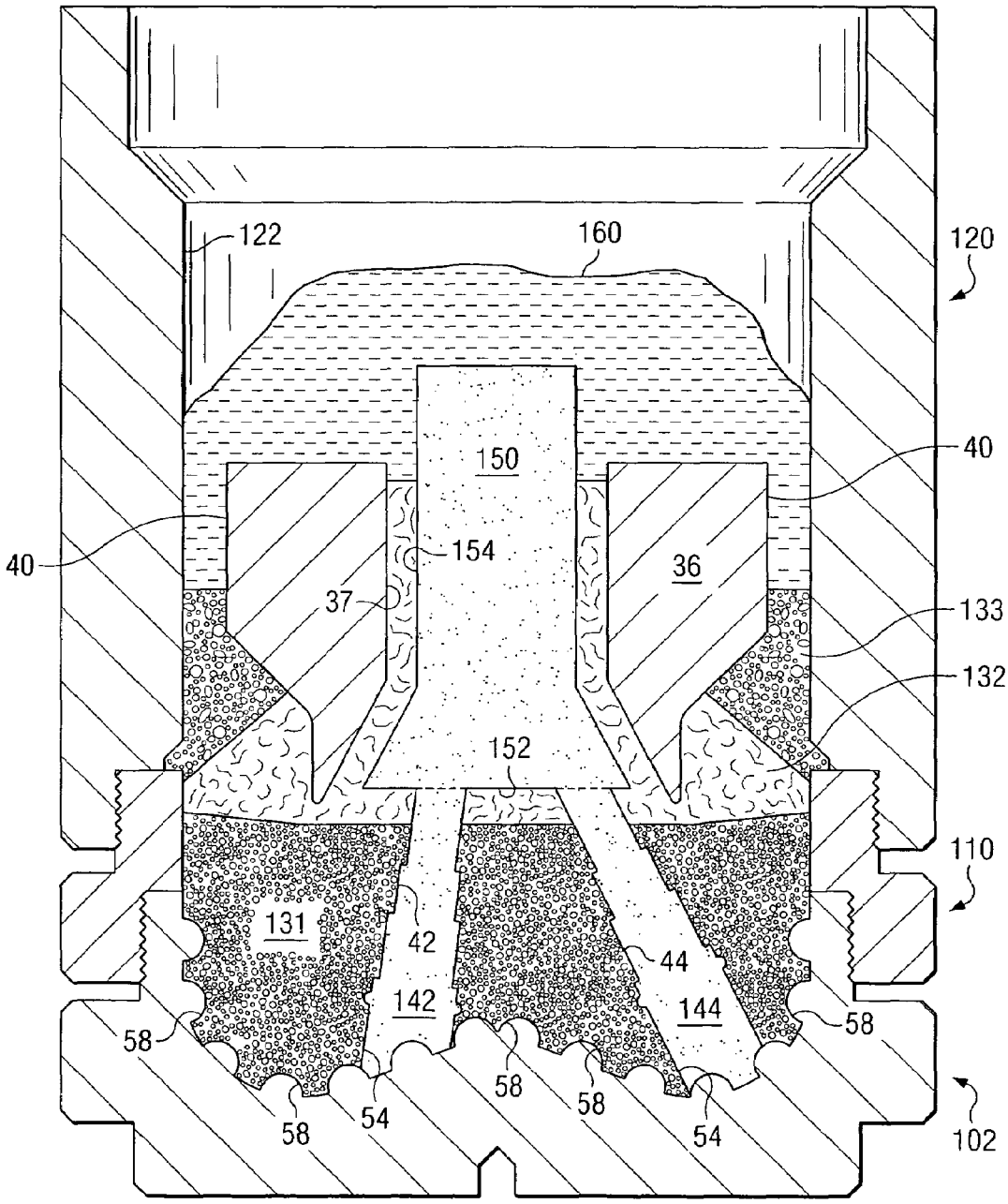
FIG. 2 is a schematic drawing in section with portions broken away showing one example of a mold assembly with a first matrix material and a second matrix material satisfactory for forming a matrix drill bit in accordance with teachings of the present disclosure.
Figure 3:
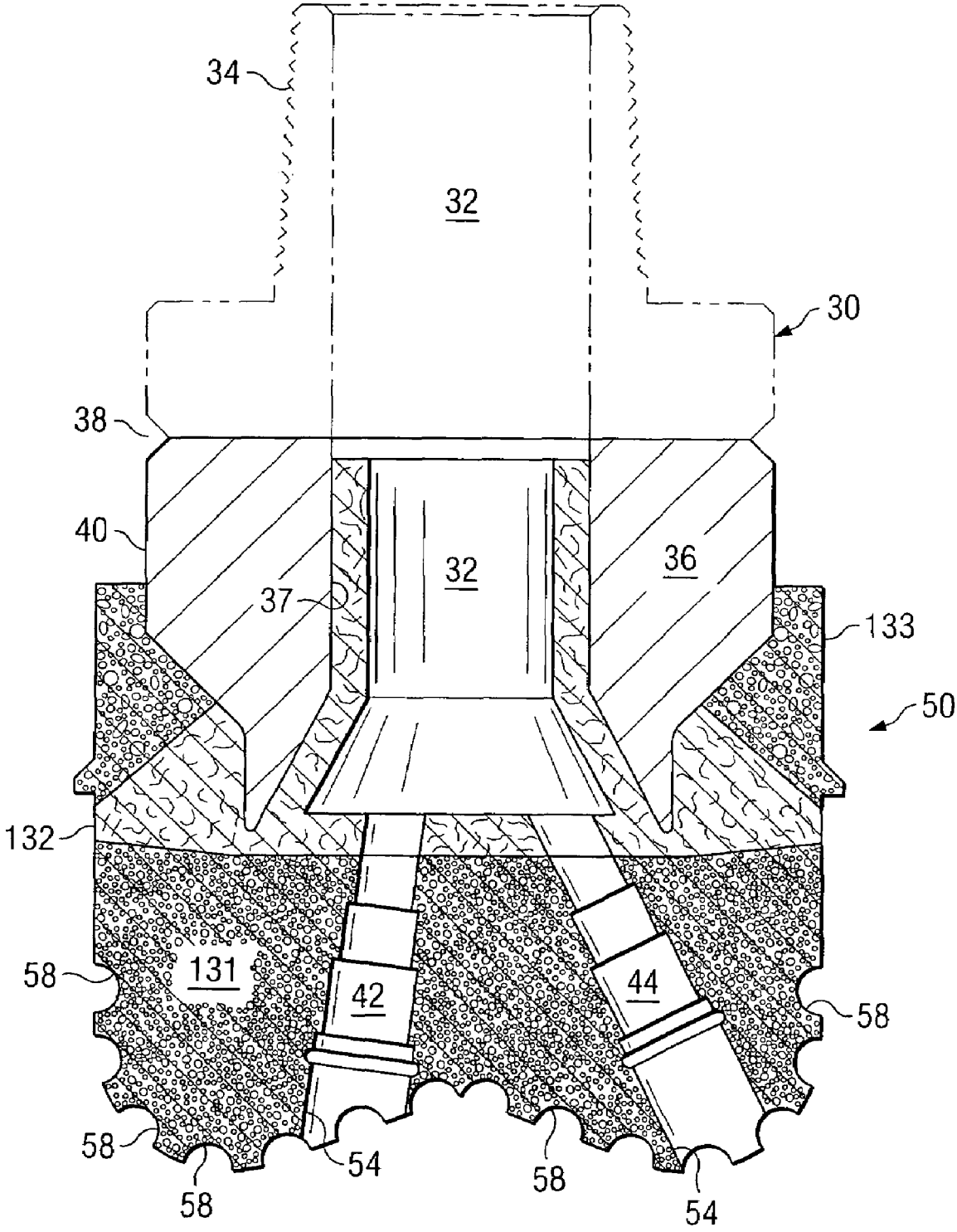
FIG. 3 is a schematic drawing in section with portions broken away showing a matrix bit body removed from the mold of FIG. 2 after binder material has infiltrated the first matrix material and the second matrix material.

A matrix drill bit may include a plurality of cutting elements, inserts, cutter pockets, cutter blades, cutting structures, junk slots, and/or fluid flow paths may be formed on or attached to exterior portions of an associated bit body. For embodiments such as shown in FIGS. 1, 2 and 3, a plurality of cutter blades 52 may form on the exterior of composite matrix bit body 50. Cutter blades 52 may be spaced from each other on the exterior of composite matrix bit body 50 to form fluid flow paths or junk slots therebetween.

A plurality of nozzle openings 54 may formed in composite bit body 50. Respective nozzles 56 may be disposed in each nozzle opening 54. For some applications nozzles 56 may be described as "interchangeable" nozzles. Various types of drilling fluid may be pumped from surface drilling equipment (not expressly shown) through a drill string (not expressly shown) attached with threaded connection 34 and fluid flow passageways 32 to exit from one or more nozzles 56. The cuttings, downhole debris, formation fluids and/or drilling fluid may return to the well surface through an annulus (not expressly shown) formed between exterior portions of the drill string and interior of an associated well bore (not expressly shown).

A plurality of pockets or recesses 58 may be formed in blades 52 at selected locations. See FIG. 3. Respective cutting elements or inserts 60 may be securely mounted in each pocket 58 to engage and remove adjacent portions of a downhole formation. Cutting elements 60 may scrape and gouge formation materials from the bottom and sides of a wellbore during rotation of matrix drill bit 20 by an attached drill string. For some applications various types of polycrystalline diamond compact (PDC) cutters may be satisfactorily used as inserts 60. A matrix drill bit having such PDC cutters may sometimes be referred to as a "PDC bit".

U.S. Pat. No. 6,296,069 entitled Bladed Drill Bit with Centrally Distributed Diamond Cutters and U.S. Pat. No. 6,302,224 entitled Drag-Bit Drilling with Multiaxial Tooth Inserts show various examples of blades and/or cutting elements which may be used with a composite matrix bit body incorporating teachings of the present disclosure. It will be readily apparent to persons having ordinary skill in the art that a wide variety of fixed cutter drill bits, drag bits and other drill bits may be satisfactorily formed with a composite matrix bit body incorporating teachings of the present disclosure. The present disclosure is not limited to matrix drill bit 20 or any specific features as shown in FIGS. 1-4.

Figure 4:
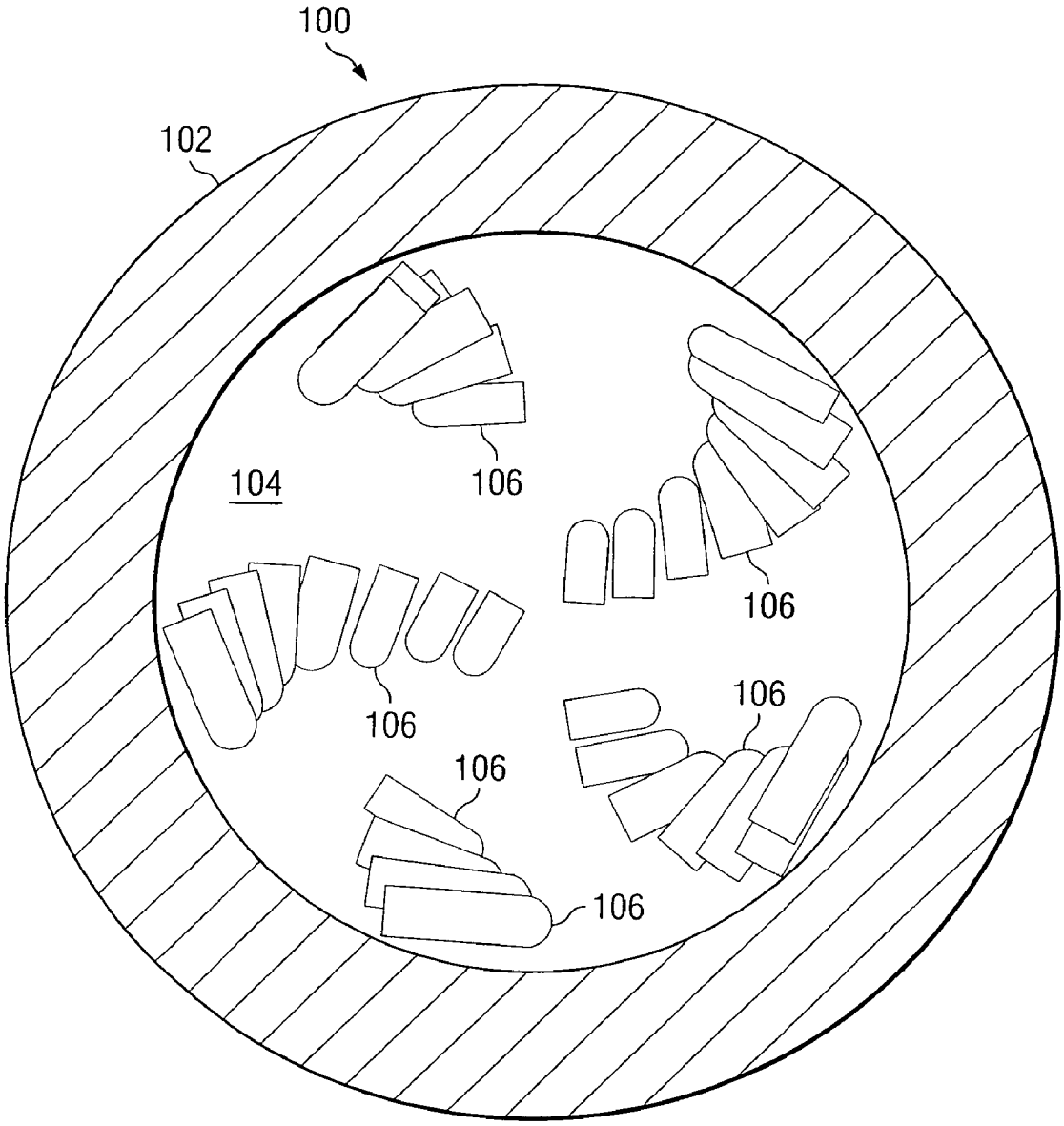
FIG. 4 is a schematic drawing in section showing interior portions of one example of a mold satisfactory for use in forming a matrix bit body in accordance with teachings of the present disclosure.

A wide variety of molds may be satisfactorily used to form a composite matrix bit body and associated matrix drill bit in accordance with teachings of the present disclosure. Mold assembly 100 as shown in FIGS. 2 and 4 represents only one example of a mold assembly satisfactory for use in forming a composite matrix bit body incorporating teachings of the present disclosure. U.S. Pat. No. 5,373,907 entitled Method And Apparatus For Manufacturing And Inspecting The Quality Of A Matrix Body Drill Bit shows additional details concerning mold assemblies and conventional matrix bit bodies.

Mold assembly 100 as shown in FIGS. 2 and 4 may include several components such as mold 102, gauge ring or connector ring 110 and funnel 120. Mold 102, gauge ring 110 and funnel 120 may be formed from graphite or other suitable materials. Various techniques may be used including, but not limited to, machining a graphite blank to produce mold 102 with cavity 104 having a negative profile or a reverse profile of desired exterior features for a resulting fixed cutter drill bit. For example mold cavity 104 may have a negative profile which corresponds with the exterior profile or configuration of blades 52 and junk slots or fluid flow passageways formed therebetween as shown in FIG. 1.

As shown in FIG. 4, a plurality of mold inserts 106 may be placed within cavity 104 to form respective pockets 58 in blades 52. The location of mold inserts 106 in cavity 104 corresponds with desired locations for installing cutting elements 60 in associated blades 52. Mold inserts 106 may be formed from various types of material such as, but not limited to, consolidated sand and graphite. Various techniques such as brazing may be satisfactorily used to install cutting elements 60 in respective pockets 58.

Various types of temporary displacement materials may be satisfactorily installed within mold cavity 104, depending upon the desired configuration of a resulting matrix drill bit. Additional mold inserts (not expressly shown) formed from various materials such as consolidated sand and/or graphite may be disposed within mold cavity 104. Various resins may be satisfactorily used to form consolidated sand. Such mold inserts may have configurations corresponding with desired exterior features of composite bit body 50 such as fluid flow passageways formed between adjacent blades 52. As discussed later in more detail, a first matrix material having increased toughness or resistance to fracture may be loaded into mold cavity 104 to form portions of an associated composite matrix bit body that engage and remove downhole formation materials during drilling of a wellbore.

Composite matrix bit body 50 may include a relatively large fluid cavity or chamber 32 with multiple fluid flow passageways 42 and 44 extending therefrom. See FIG. 3. As shown in FIG. 2, displacement materials such as consolidated sand may be installed within mold assembly 100 at desired locations to form portions of cavity 32 and fluid flow passages 42 and 44 extending therefrom. Such displacement materials may have various configurations. The orientation and configuration of consolidated sand legs 142 and 144 may be selected to correspond with desired locations and configurations of associated fluid flow passageways 42 and 44 communicating from cavity 32 to respective nozzle outlets 54. Fluid flow passageways 42 and 44 may receive threaded receptacles (not expressly shown) for holding respective nozzles 56 therein.

A relatively large, generally cylindrically shaped consolidated sand core 150 may be placed on the legs 142 and 144. Core 150 and legs 142 and 144 may be sometimes described as having the shape of a "crow's foot." Core 150 may also be referred to as a "stalk." The number of legs extending from core 150 will depend upon the desired number of nozzle openings in a resulting composite bit body. Legs 142 and 144 and core 150 may also be formed from graphite or other suitable material.

After desired displacement materials, including core 150 and legs 142 and 144, have been installed within mold assembly 100, first matrix material 131 having optimum fracture resistance characteristics (toughness) and optimum erosion, abrasion and wear resistance, may be placed within mold assembly 100. First matrix material 131 will preferably form a first zone or a first layer which will correspond approximately with exterior portions of composite matrix bit body 50 which contact and remove formation materials during drilling of a wellbore. The amount of first matrix material 131 add to mold assembly 120 will preferably be limited such that matrix material 131 does not contact end 152 of core 150. The present disclosure allows the use of matrix materials having optimum characteristics of toughness and wear resistance for forming a fix cutter drill bit or drag bit.

A generally hollow, cylindrical metal blank 36 may then be placed within mold assembly 100. Metal blank 36 preferably includes inside diameter 37 which is larger than the outside diameter of sand core 150. Various fixtures (not expressly shown) may be used to position metal blank 36 within mold assembly 100 at a desired location spaced from first matrix material 131.

Second matrix material 132 may then be loaded into mold assembly 100 to fill a void space or annulus formed between outside diameter 154 of sand core 150 and inside diameter 37 of metal blank 36. Second matrix material 132 preferably covers first matrix material 131 including portions of first matrix material 131 located adjacent to and spaced from end 152 of core 150.

For some applications second matrix material 132 is preferably loaded in a manner that eliminates or minimizes exposure of second matrix material 132 to exterior portions of composite matrix bit body 50. First matrix material 131 may be primarily used to form exterior portions of composite matrix bit body 50 associated with cutting, gouging and scraping downhole formation materials during rotation of matrix drill bit 20 to form a wellbore. Second matrix material 132 may be primarily used to form interior portions and exterior portions of composite matrix bit body 50 which are not normally associated cutting, gouging and scraping downhole formation materials. See FIGS. 2 and 3.

For some applications third matrix material 133 such as tungsten powder may then be placed within mold assembly 100 between outside diameter 40 of metal blank 36 and inside diameter 122 of funnel 120. Third matrix material 133 may be a relatively soft powder which forms a matrix that may subsequently be machined to provide a desired exterior configuration and transition between matrix bit body 50 and metal shank 36. Third matrix 133 may sometimes be described as an "infiltrated machinable powder." Third matrix material 133 may be loaded to cover all or substantially all second matrix material 132 located proximate outer portions of composite matrix bit body 50. See FIGS. 2 and 3.

During the loading of matrix material 131, 132 and 133 care should be taken to prevent undesired mixing between first matrix material 131 and second matrix material 132 and undesired mixing between second matrix material 132 and third matrix material 133. Slight mixing at the interfaces to avoid sharp boundaries between different matrix materials may provide smooth transitions for bonding between adjacent layers. Prior experience and testing has demonstrated various problems associated with infiltrating cemented carbides and spherical carbides with hot, liquid binder material when the cemented carbides and spherical carbides are disposed in relatively complex mold assemblies associated with matrix bit bodies for fixed cutter drill bits. Similar problems have been noted when attempting to form matrix bodies with cemented carbides and/or spherical carbides for other types of complex downhole tools associated with drilling and producing oil and gas wells.

Manufacturing problems and resulting quality problems associated with using cemented carbides and/or spherical carbides as matrix material are generally associated with lack of infiltration, porosity, shrinkage, cracking and segregation of binder material constituents within interior portions of a resulting matrix bit body. Relatively complicated, intricate designs and relatively large sizes of many fixed cutter drill bits present difficult challenges to manufacturability of bit bodies having cemented carbides and/or spherical carbides as the matrix materials. These same quality problems may occur during manufacture of other downhole tools formed at least in part by a matrix of cemented carbides and spherical carbides such as reamers, underreamers, and combined reamers/drill bits. One example of such combined downhole tools is shown in U.S. Pat. No. 5,678,644 entitled "Bi-center And Bit Method For Enhanced Stability."

Previous testing and experimentation associated with premixing cemented carbides and/or spherical carbides with macrocrystalline tungsten carbide and/or cast carbide powders often failed to produce a sound, high quality matrix bit body. Increasing soak time of binder material within such mixtures of cemented carbides and/or spherical carbides with macrocrystalline tungsten carbide and/or cast carbide powders did not substantially eliminate quality problems related to shrinkage, alloy segregation, lack of infiltration, porosity and other problems associated with unsatisfactory infiltration of cemented carbides and/or spherical carbides. Also, increasing the temperature of hot, liquid binder material used for infiltration of such mixtures did not substantially reduce associated quality problems. High alloy segregation in the last solidifying portion of liquid binder material within various mixtures of cemented carbides and/or spherical carbides with macrocrystalline tungsten carbide and/or cast carbides was identified as one cause for lack of bonding within such mixtures, undesired shrinkage, porosity and other quality problems.

The use of first matrix material 131 to form a first layer or zone in combination with using second matrix material 132 to form a second layer or zone adjacent to first matrix material 131 may substantially reduce or eliminate alloy segregation in the last solidifying portion of hot, liquid binder material with first matrix material 131. The addition of second matrix material 132 in the annulus formed between outside diameter 154 of core 150 and inside diameter 37 of metal blank 36 and covering first matrix material 131 such as shown in FIG. 2 may substantially reduce or eliminate problems related to lack of infiltration, porosity, shrinkage, cracking and/or segregation of binder constituents within first matrix material 131. One reason for these improvements may be the ease with which hot, liquid binder material infiltrates macrocrystalline tungsten carbide and/or cast carbide powders.

As previously noted, hot, liquid binder material may leach or remove small quantities of alloys and/or other contaminates from bonding materials used to form cemented carbides. The leached alloys and/or other contaminates may have a higher melting point than typical binder materials associated with fabrication of matrix drill bits. Therefore, the leached alloys and/or other contaminates may solidify in small gaps or voids formed between adjacent cemented carbide pellets, spheres or other shapes and block further infiltration of hot, liquid binder material between such cemented carbide shapes.

The "contaminated" infiltrant or hot, liquid binder material may have solidus and liquidus temperatures different from "virgin" binder materials. Further "enrichment" of an infiltrant with contaminants may take place during solidification of the binder material as a result of rejection of solute contaminants into hot liquid ahead of a solidification front. Besides segregation of contaminants (solute) in later stages of solidification, any lack of directional solidification may give rise to potential problems including, but not limited to, shrinkage, porosity and/or hot tearing.

Macrocrystalline tungsten carbide and cast carbide powders may be substantially free of alloys or other contaminates associated with bonding materials used to form cemented carbides. The second matrix material may be selected to have less than five percent (5%) alloys or potential other contaminates. Therefore, infiltration of hot, liquid binder material through a second matrix material selected in accordance with teachings of the present disclosure will generally not leach significant amounts of alloys or other potential contaminates.

First matrix material 131 may be cemented carbides and/or spherical carbides as previously discussed. Alloys of cobalt, iron and/or nickel may be used to form cemented carbides and/or spherical carbides. For some matrix drill bit designs an alloy concentration of approximately six percent in the first matrix material may provide optimum results. Alloy concentrations between three percent and six percent and between approximately six percent and fifteen percent may also be satisfactory for some matrix drill bit designs. However, alloy concentrations greater than approximately fifteen percent and alloy concentrations less than approximately three percent may result in less than optimum characteristics of a resulting matrix bit body.

Second matrix material 132 may be monocrystalline tungsten carbide or cast carbide powders. Examples of such powders include P-90 and P-100 which are commercially available from Kennametal, Inc. located in Fallon, Nev. U.S. Pat. No. 4,834,963 entitled "Macrocrystalline Tungsten Monocarbide Powder and Process for Producing" assigned to Kennametal describes techniques which may be used to produce macrocrystalline tungsten carbide powders. Third matrix material 133 may be tungsten powder such as M-70, which is also commercially available from H. C. Starck, Osram Sylvania and Kennametal. Typical alloy concentrations in second matrix material 132 may be between approximately one percent and two percent. Second matrix materials having an alloy concentration of approximately five percent or greater may result in unsatisfactory operating characteristics for an associated matrix bit body.

A typical infiltration process for casting composite matrix bit body 50 may begin by forming mold assembly 100. Gage ring 110 may be threaded onto the top of mold 102. Funnel 120 may be threaded onto the top of gage ring 110 to extend mold assembly 100 to a desired height to hold previously described matrix materials and binder material. Displacement materials such as, but not limited to, mold inserts 106, legs 142 and 144 and core 150 may then be loaded into mold assembly 100 if not previously placed in mold cavity 104. Matrix materials 131, 132, 133 and metal blank 36 may be loaded into mold assembly 100 as previously described.

As mold assembly 100 is being filled with matrix materials, a series of vibration cycles may be induced in mold assembly 100 to assist packing of each layer or zone or matrix materials 131, 132 and 133. The vibrations help to ensure consistent density of each layer of matrix materials 131, 132 and 133 within respective ranges required to achieve desired characteristics for composite matrix bit body 50. Undesired mixing of matrix materials 131, 132 and 133 should be avoided.

Binder material 160 may be placed on top of layers 132 and 133, metal blank 36 and core 150. Binder material 160 may be covered with a flux layer (not expressly shown). A cover or lid (not expressly shown) may be placed over mold assembly 100. Mold assembly 100 and materials disposed therein may be preheated and then placed in a furnace (not expressly shown). When the furnace temperature reaches the melting point of binder material 160, liquid binder material 160 may infiltrate matrix materials 131, 132 and 133. As previously noted, second matrix material 132 allows hot, liquid binder material 160 to more uniformly infiltrate first matrix material 131 to avoid undesired segregation in the last solidifying portions of liquid binder material 160 with first matrix material 131.

Upper portions of mold assembly 100 such as funnel 120 may have increased insulation (not expressly shown) as compared with mold 102. As a result, hot, liquid binder material in lower portions of mold assembly 100 will generally start to solidify with first matrix material 131 before hot, liquid binder material solidifies with second matrix material 132. The difference in solidification may allow hot, liquid binder material to "float" or transport alloys and other potential contaminates leached from first matrix material 131 into second matrix material 132. Since the hot, liquid matrix material infiltrated through second matrix material 132 prior to infiltrating first matrix material 131, alloys and other contaminates transported from first matrix material 131 may not affect quality of resulting matrix bit body 50 as much as if the alloys and other contaminates had remained within first matrix material 131. Also, the second matrix material preferably contains less than four percent (4%) of such alloys or contaminates.

Proper infiltration and solidification of binder material 160 with first matrix material 131 is particularly important at locations adjacent to features such as nozzle openings 54 and pockets 58. Improved quality control from enhanced infiltration of binder material 160 into portions of first matrix material 131 which forms respective blades 52 may allow designing thinner blades 52. Blades 52 may also be oriented at more aggressive cutting angles with greater fluid flow areas formed between adjacent blades 52.

For some fixed cutter drill bit designs forming a composite bit body with a first matrix material and a second matrix material in accordance with teachings of the present disclosure may result in as much as fifty percent (50%) improvement in abrasion resistance, one hundred percent (100%) improvement in erosion resistance, fifty percent (50%) improvement in transverse rupture strength and sometimes more than one hundred percent (100%) improvement in impact resistance as compared with the same design of fixed cutter drill bit having a matrix bit body formed with only commercially available macrocrystalline tungsten carbide and/or cast carbide powders, or formulate thereof.

Mold assembly 100 may then be removed from the furnace and cooled at a controlled rate. Once cooled, mold assembly 100 may be broken away to expose composite matrix bit body 50 as shown in FIG. 3. Subsequent processing according to well-known techniques may be used to produce matrix drill bit 20.

Although the present disclosure and its advantages have been described in detail, it should be understood that various changes, substitutions and alternations can be made herein without departing from the spirit and scope of the disclosure as defined by the following claims.

What is claimed is:

1. A drill bit having a matrix bit body comprising:

a plurality of cutting elements disposed at selected locations on exterior portions of the matrix bit body;

at least a first matrix material and a second matrix material with the first matrix material having increased resistance to impact as compared with the second matrix material;

the first matrix material forming exterior portions of the matrix bit body associated with engaging and removing formation materials from a wellbore;

the second matrix material forming interior portions of the matrix bit body which are generally not associated with engaging and removing formation materials from a wellbore;

the second matrix material operable to improve infiltration of a hot, liquid binder material throughout the first matrix material to minimize incomplete infiltration of the first matrix material by the hot, liquid binder material; and the second matrix material having a substantially reduced amount of alloys and other potential contaminants which may be leached by hot, liquid binder material as compared with alloys and other potential contaminants which may be leached by hot, liquid binder material from the first matrix material.

2. The matrix drill bit of claim 1 further comprising the second matrix material operable to accommodate alloys or other contaminates leached from the first matrix material by hot, liquid binder material without substantially reducing the quality of bonding formed by the hot, liquid binder material contacting and solidifying with the second matrix material.

3. A drill bit having a matrix bit body comprising:

a plurality of cutting elements disposed at selected locations on exterior portions of the matrix bit body;

at least a first matrix material and a second matrix material with the first matrix material having increased resistance to impact as compared with the second matrix material;

the first matrix material forming exterior portions of the matrix bit body associated with engaging and removing formation materials from a wellbore;

the second matrix material forming interior portions of the matrix bit body which are generally not associated with engaging and removing formation materials from a wellbore;

the second matrix material operable to improve infiltration of a hot, liquid binder material throughout the first matrix material to minimize incomplete infiltration of the first matrix material by the hot, liquid binder material; and a third matrix material covering the second matrix material.

4. The matrix drill bit of claim 3 wherein the third matrix material comprises at least in part a tungsten powder.

5. A drill bit having a composite matrix bit body comprising:

a plurality of cutting elements disposed at select locations on exterior portions of the bit body;

the composite matrix bit body having at least a first zone and a second zone disposed adjacent to each other;

the first zone formed at least in part by hard particles comprising cemented carbides and at least one binder material selected from the group consisting of cobalt, nickel, iron or alloys of these elements; and the second zone formed at least in part from hard particles selected from the group consisting of macrocrystalline tungsten carbides and cast carbides;

the second zone formed by the same binder material as the first zone; and the second matrix material comprises less than four percent alloy materials and other contaminates.

6. A drill bit having a composite matrix bit body comprising:

a plurality of cutting elements disposed at select locations on exterior portions of the bit body;

the composite matrix bit body having at least a first zone and a second zone disposed adjacent to each other;

the first zone formed at least in part by hard particles comprising cemented carbides and at least one binder material selected from the group consisting of cobalt, nickel, iron or alloys of these elements; and the second zone formed at least in part from hard particles selected from the group consisting of macrocrystalline tungsten carbides and cast carbides;

the second zone formed by the same binder material as the first zone; and the first zone further comprises hard particles having an alloy concentration of less than approximately six percent.

7. A drill bit having a composite matrix bit body comprising:

a plurality of cutting elements disposed at select locations on exterior portions of the bit body;

the composite matrix bit body having at least a first zone and a second zone disposed adjacent to each other;

the first zone formed at least in part by hard particles comprising cemented carbides and at least one binder material selected from the group consisting of cobalt, nickel, iron or alloys of these elements; and the second zone formed at least in part from hard particles selected from the group consisting of macrocrystalline tungsten carbides and cast carbides;

the second zone formed by the same binder material as the first zone; and the hard particles having an alloy concentration between approximately three percent and six percent.

8. A drill bit having a composite matrix bit body comprising:

a plurality of cutting elements disposed at select locations on exterior portions of the bit body;

the composite matrix bit body having at least a first zone and a second zone disposed adjacent to each other;

the first zone formed at least in part by hard particles comprising cemented carbides and at least one binder material selected from the group consisting of cobalt, nickel, iron or alloys of these elements; and the second zone formed at least in part from hard particles selected from the group consisting of macrocrystalline tungsten carbides and cast carbides;

the second zone formed by the same binder material as the first zone; and the first matrix material having a concentration of cobalt between about six percent and twenty percent.

9. A drill bit having a composite matrix bit body comprising:

a plurality of cutting elements disposed at select locations on exterior portions of the bit body;

the composite matrix bit body having at least a first zone and a second zone disposed adjacent to each other;

the first zone formed at least in part by hard particles comprising cemented carbides and at least one binder material selected from the group consisting of cobalt, nickel, iron or alloys of these elements; and the second zone formed at least in part from hard particles selected from the group consisting of macrocrystalline tungsten carbides and cast carbides;

the second zone formed by the same binder material as the first zone; and the second matrix material having increased wettability when exposed to hot, liquid binder material as compared with wettability of the first matrix material.

* * * * *